US006964552B1

(12) United States Patent
Krabbendam

(10) Patent No.: US 6,964,552 B1
(45) Date of Patent: Nov. 15, 2005

(54) METHOD FOR LIFTING AND TRANSPORTING A HEAVY LOAD USING A DEEP WATER DEPLOYMENT SYSTEM

(76) Inventor: Richard L. Krabbendam, PO Box 23016, Rotterdam, 3001 KA (NL)

( * ) Notice: Subject to any disclaimer, the term of this patent is extended or adjusted under 35 U.S.C. 154(b) by 152 days.

(21) Appl. No.: 10/461,618

(22) Filed: Jun. 13, 2003

(51) Int. Cl.[7] ..... B63B 27/00; B63B 35/00; B65G 37/60

(52) U.S. Cl. ..... 414/803; 414/137.1; 414/138.7; 414/139.4; 414/140.4; 414/142.6

(58) Field of Search ..... 414/137.1, 138.5, 414/138.7, 140.3, 140.4, 141.6, 142.6, 142.7, 414/139.2, 803

(56) References Cited

U.S. PATENT DOCUMENTS 4,003,472 A * 1/1977 Reynolds et al. ..... 414/139.6
4,448,396 A * 5/1984 Delago ..... 414/139.6
4,854,800 A * 8/1989 Frick et al. ..... 414/138.2
6,789,997 B2 * 9/2004 Coblentz ..... 414/803

* cited by examiner

*Primary Examiner*—Gene O. Crawford
(74) *Attorney, Agent, or Firm*—Buskop Law Group, P.C.; Wendy Buskop

(57) ABSTRACT

The invention is a method for lifting and transporting a heavy load comprising using a heavy lift vessel with at least two heavy lift cranes adapted to operate simultaneously; mounting a deep water deployment system on each crane adapted to increase hook travel the crane; shifting the load from the first location to over a second location on the heavy lift vessel; placing the load on the second location; moving the heavy lift vessel to a second position; using a conventional mooring system to maintain the heavy lift vessel at the second position; picking up the load from the second location using the cranes simultaneously; shifting the load from a second location to over a third location; and placing the load on the third location.

4 Claims, 8 Drawing Sheets

METHOD FOR LIFTING AND TRANSPORTING A HEAVY LOAD USING A DEEP WATER DEPLOYMENT SYSTEM

FIELD OF THE INVENTION

The invention relates to a method for lifting and transporting a heavy load using a heavy lift crane equipped with a water deployment system adapted to increase hook travel heavy lift crane.

BACKGROUND OF THE INVENTION

As global commerce has expanded, it has become increasingly necessary to effectively transport goods from one location to a remote location that transverses over water. Containers of goods are transported inland by means of railroads, trucks, inland waterway vessels, etc. The permissible range of operation of land-bound carriers or vessels for inland navigation ends at the coast. At that point, cargo transported by inland waterway vessels must be transferred from a non-seaworthy inland vessel to a seaworthy ship. Cargo must also be loaded from land locations to the seaworthy ships.

Transportation problems compound and the risk of loss increases as the cargo becomes heavier, requiring heavy lift cranes.

A need exists for a heavy lift vessel that can carry cargo, such as heavy structures, over long distances at a high rate of speed.

Current methods for transporting heavy structures over waterways and the open oceans incorporate the use of barges as an intermediate transport vehicle. Currently, heavy structures are transported using barges. These methods are inconvenient, time-consuming, and costly to move heavy structures from one location to another. Conventional installation vessels, such as crane barges or crane vessels, require in most cases a separate barge or heavy lift transport vessel to transport the offshore structures.

Since the use of multiple vessels and barges increases the risk of damage to the cargo and workers, a need exists for a heavy lift vessel that can self-load, transport, and install cargo in one vessel. The use of one vessel versus multiple vessels would lower insurance premiums and also provide a safer environment for both cargo and the workers on the ship.

SUMMARY OF THE INVENTION

The invention relates to a method for lifting and transporting a heavy load using a heavy lift vessel with at least two heavy lift cranes adapted to operate simultaneously. The heavy lift cranes are equipped with a water deployment system adapted to increase hook travel of the heavy lift crane. The method begins by picking up a load from a first location using the heavy lift cranes simultaneously; shifting the load over a second location on the heavy lift vessel; and placing the load on the second location. The heavy lift vessel, then, moves to a second positioned where it is moored to maintain its position. The method ends by picking up the load from the second location using the heavy lift cranes simultaneously; shifting the load from a second location to over a third location; and placing the load on the third location.

BRIEF DESCRIPTION OF THE DRAWINGS

The present invention will be explained in greater detail with reference to the appended Figures, in which.

The present invention is detailed below with reference to the listed Figures.

DETAILED DESCRIPTION OF THE PREFERRED EMBODIMENTS

Before explaining the present invention in detail, it is to be understood that the invention is not limited to the particular embodiments herein and it can be practiced or carried out in various ways.

The present invention is a method for lifting and transporting a heavy load. The invention was developed to convert these heavy lifting ships into heavy transportation and installation vessels for use in the offshore sector. The preferred vessels are mono-hull transportation vessels, equipped with at least two heavy lift mast cranes.

The present invention is a method for lifting a load using a heavy lift ship equipped with modular units.

The fly-jib module is fitted to the existing crane jibs in order to extend outreach and lifting height of the crane. An example of the useful need of the fly-jib module is installing a topside construction onto floating production storage and offloading facilities (FPSO).

The suction anchor module when installed on the heavy lift ship stabilizes the roll, the pitch, and the heave of the vessel. The suction anchor module enables the stabilized vessel to work heavy lift cranes in an offshore environment under a significant wave height.

The deep water deployment system (or extra hoisting winches module) when connected to an individual heavy lift crane increases the wire rope storage capacity. The deep water deployment system is typically positioned in the lower hold. A set of guide sheaves replaces the existing hoist winches of the individual heavy lift crane to achieve an increased hook travel of the main crane blocks. The increased hook travel allows the heavy lift vessel to be able to lower subsea structures to a water depth of up to 3000 meters.

The modular dynamic positioning system allows the heavy lift vessel to operate within a deep water environment without conventional mooring anchors.

The modular heave compensation system is typically installed in the main hoist wire rope tackle in order to absorb shock loads caused by the heavy lift vessel's motion when placing a load on the seabed.

Figure 1:
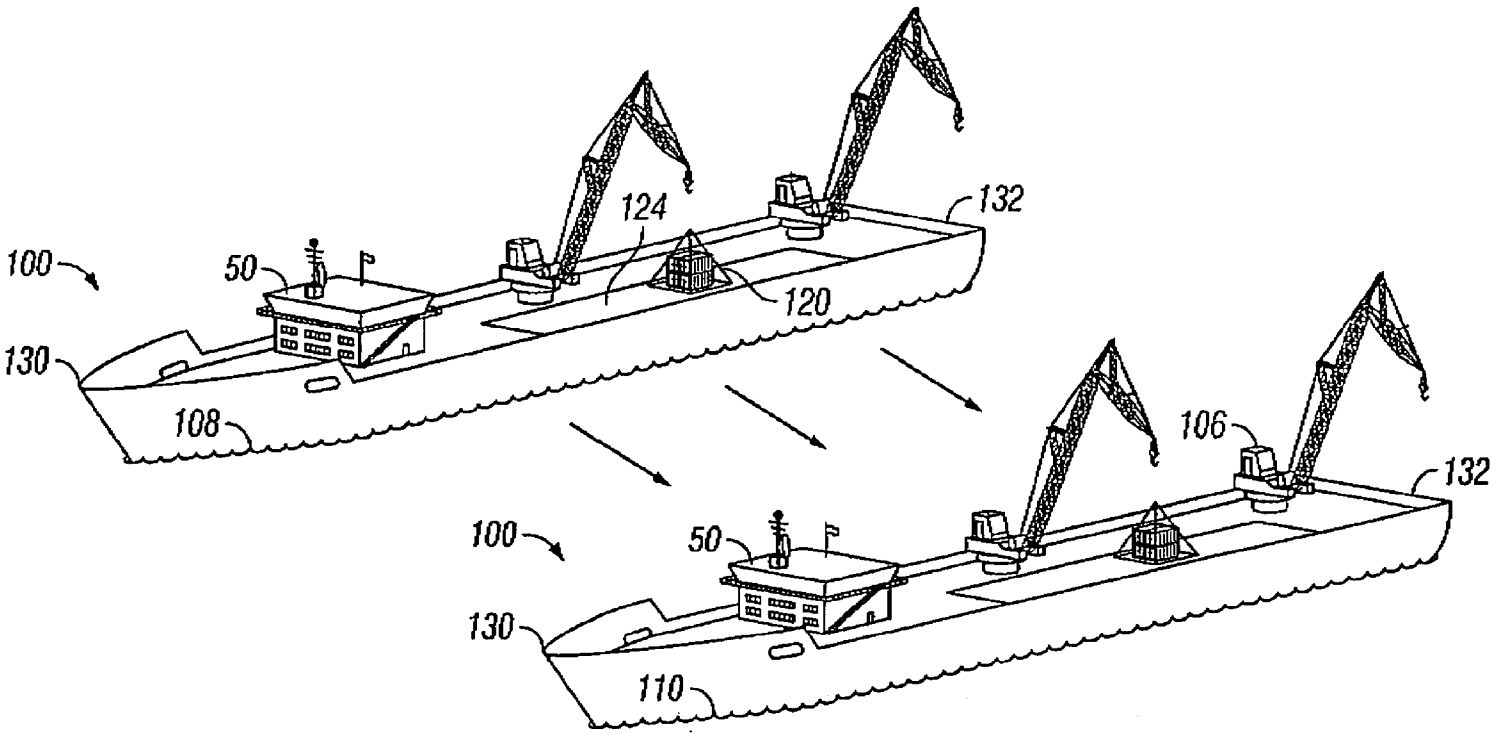
FIG. 1 depicts the heavy lift vessel lifting and transporting a load from a first position to a second position.

The present invention is a method for lifting and transporting a heavy load using a modified heavy lift vessel (100) as shown in FIG. 1. The typical heavy lift vessel has a bow (130), a stern (132) and a bridge (50). The method of inventions is applicable for any type of heavy lift vessel, such as mono-hull vessels, catamaran hull vessels, and tri-maran hull vessels. The heavy lift vessel can also be equipped with a heave compensator.

Figure 2A:
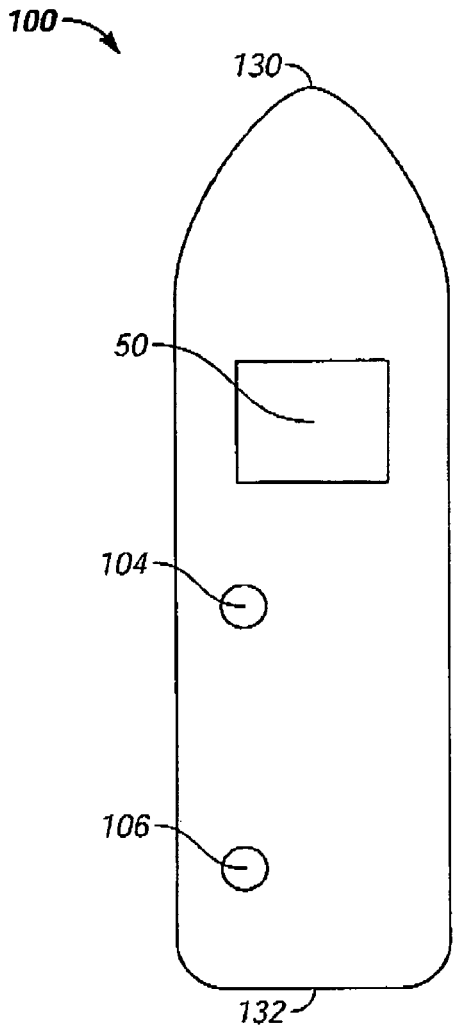
FIG. 2*a* depicts the positioning of the heavy lift cranes on the heavy lift vessel.
Figure 2B:
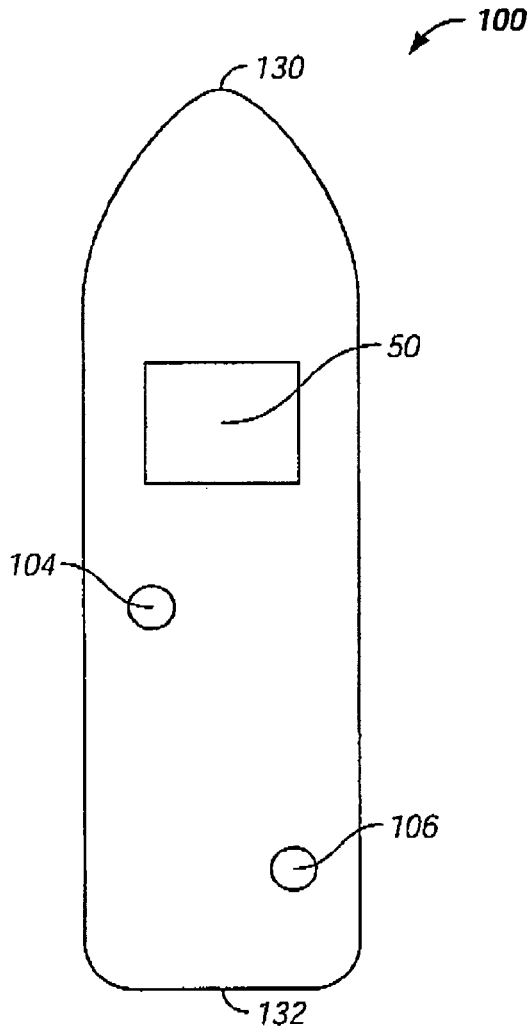
FIG. 2*b* depicts the positioning of the heavy lift cranes on the heavy lift vessel.
Figure 2C:
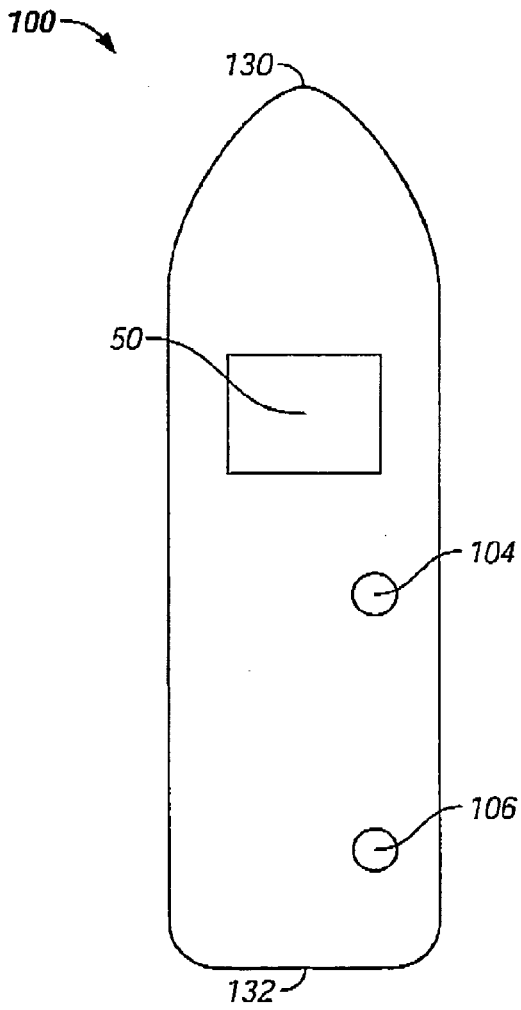
FIG. 2*c* depicts the positioning of the heavy lift cranes on the heavy lift vessel.
Figure 2D:
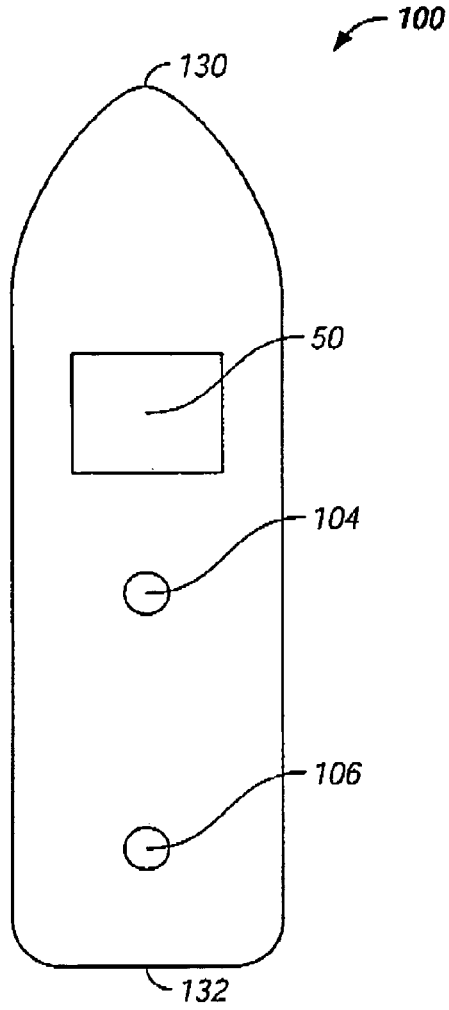
FIG. 2*d* depicts the positioning of the heavy lift cranes on the heavy lift vessel.

The heavy lift vessel also has a first heavy lift crane (104) and a second heavy lift crane (106) connected to the heavy lift vessel adapted to operate simultaneously. The two heavy lift cranes can be placed in a variety of orientations on the heavy lift vessel. Examples of heavy lift crane orientations are shown in FIG. 2*a*, FIG. 2*b*, and FIG. 2*c*. FIG. 2*d* shows a vessel having two cranes 104 and 106. A heavy lift vessel can also have a single heavy lift crane. The heavy lift cranes can also be mast cranes and other crane type lifting devices. Even though the preferred embodiment is two heavy lift cranes on a single heavy lift vessel, the invention contemplates that three or more cranes may be present.

Figure 4:
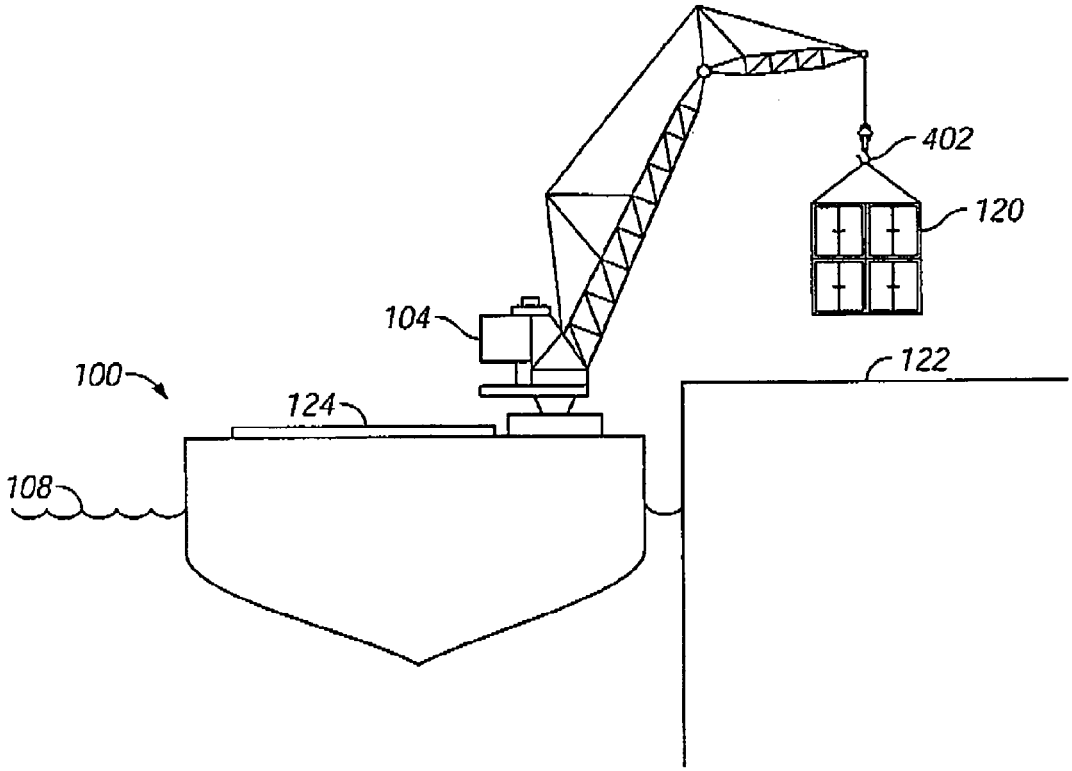
FIG. 4 depicts the heavy lift cranes picking up a load from a first location on land to a second location on a vessel.

As shown in FIG. 4, the method continues by picking up a load (120) from a first location (122) using the first and second heavy lift cranes simultaneously, shifting the load from the first location (122) to over a second location (124) on the heavy lift vessel, and placing the load on the second location.

Figure 3A:
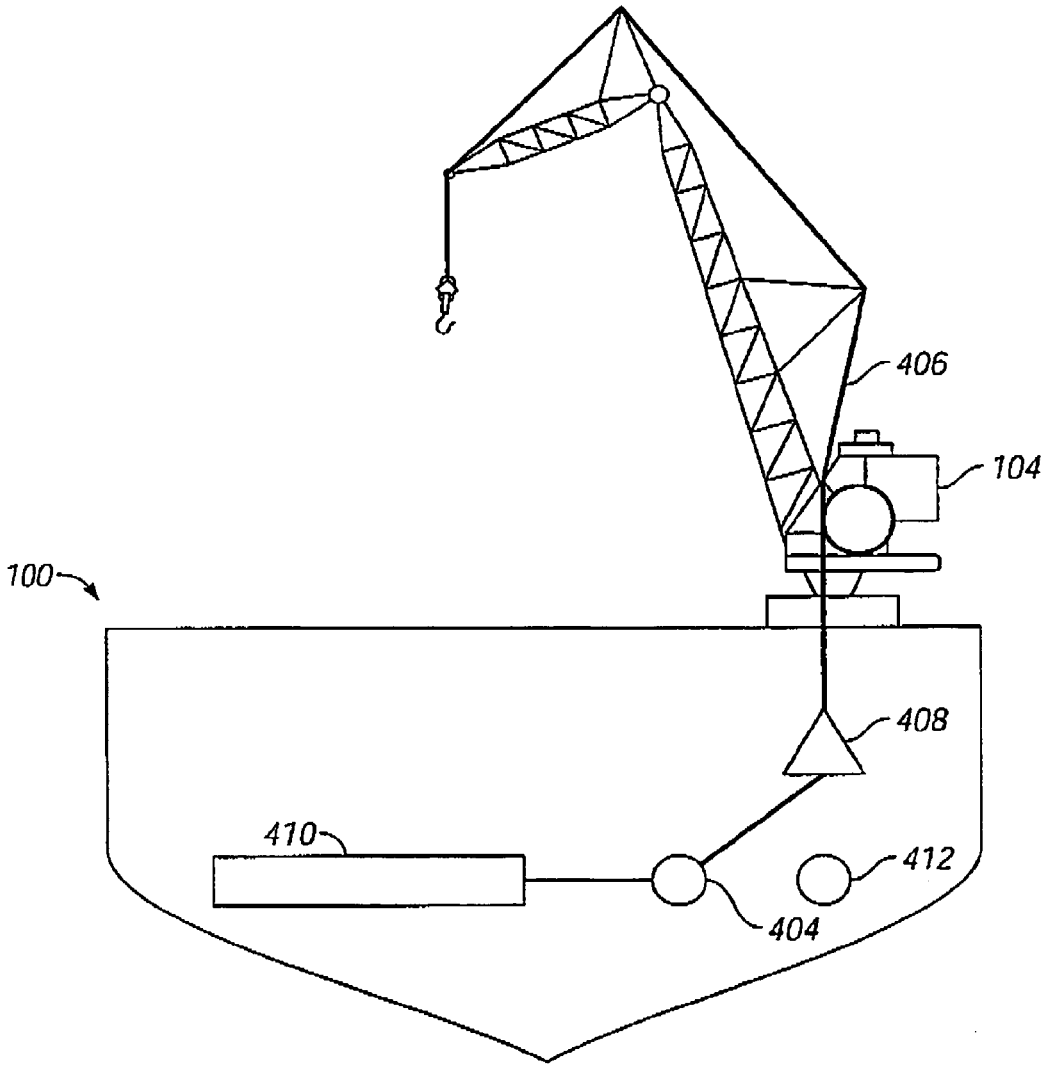
FIG. 3*a* depicts the heavy lift vessel with the deep water deployment system connected to a heavy lift crane.

To assist in the step of pickup the load, the heavy lift vessel uses a deep water deployment system (400). The deep water deployment system (400) is shown in FIG. 3*a*. The deep water deployment system is connected to an individual heavy lift crane to increase the hook travel of the crane. The deep water deployment system (400) has a main hoist winch (404), a wire rope disposed in the heavy lift vessel (406), and a plurality of guide sheaves (408). The main hoist winch (404) of the deep water deployment system (400) bypasses the crane hoist winch (412). The main hoist winch can be a traction winch, a linear winch, or a normal winch. The deep water deployment system (400) can also include separate heave compensators (410) associated with each system. A deep water deployment system (400) can be connected to one or all of the cranes on a given heavy lift vessel.

The heavy lift vessel with the load then moves from the first position where the load was added to a second position where the load is to be unloaded. A mooring system maintains the heavy lift vessel at the second position.

Figure 3B:
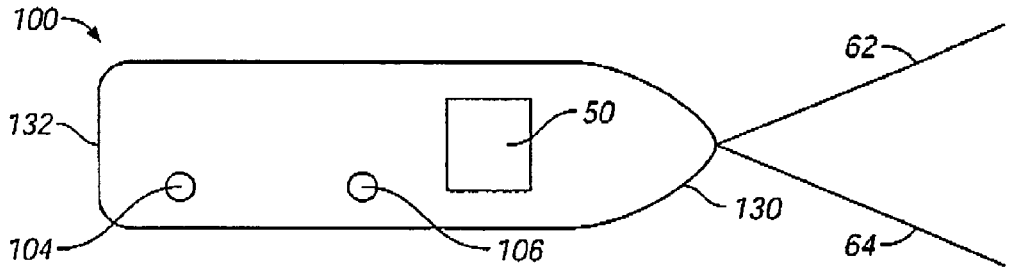
FIG. 3*b* depicts the heavy lift vessel with a conventional mooring system.

The preferred mooring system is a conventional anchoring system as shown in FIG. 3*b*. The conventional anchoring system uses at least two anchors (62 and 64) connected to the bow of the heavy lift vessel and a seabed.

Figure 3C:
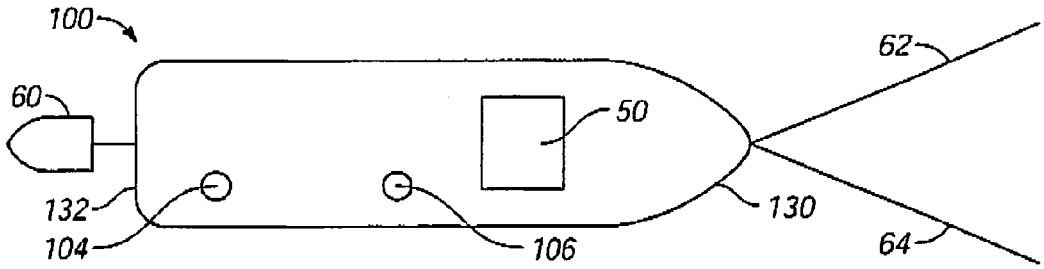
FIG. 3*c* depicts the heavy lift vessel with a conventional mooring system using a tugboat.

The conventional anchoring system can also use a tugboat (60) connected to the stern of the heavy lift vessel by a wire rope line in combination with at least two anchors (62 and 64) connected to the bow of the heavy lift vessel and a seabed. The tugboat maintains the heavy lift vessel in the direction of prevailing current and wind. The conventional anchoring system with the tugboat (60) is shown in FIG. 3*c*.

Figure 5:
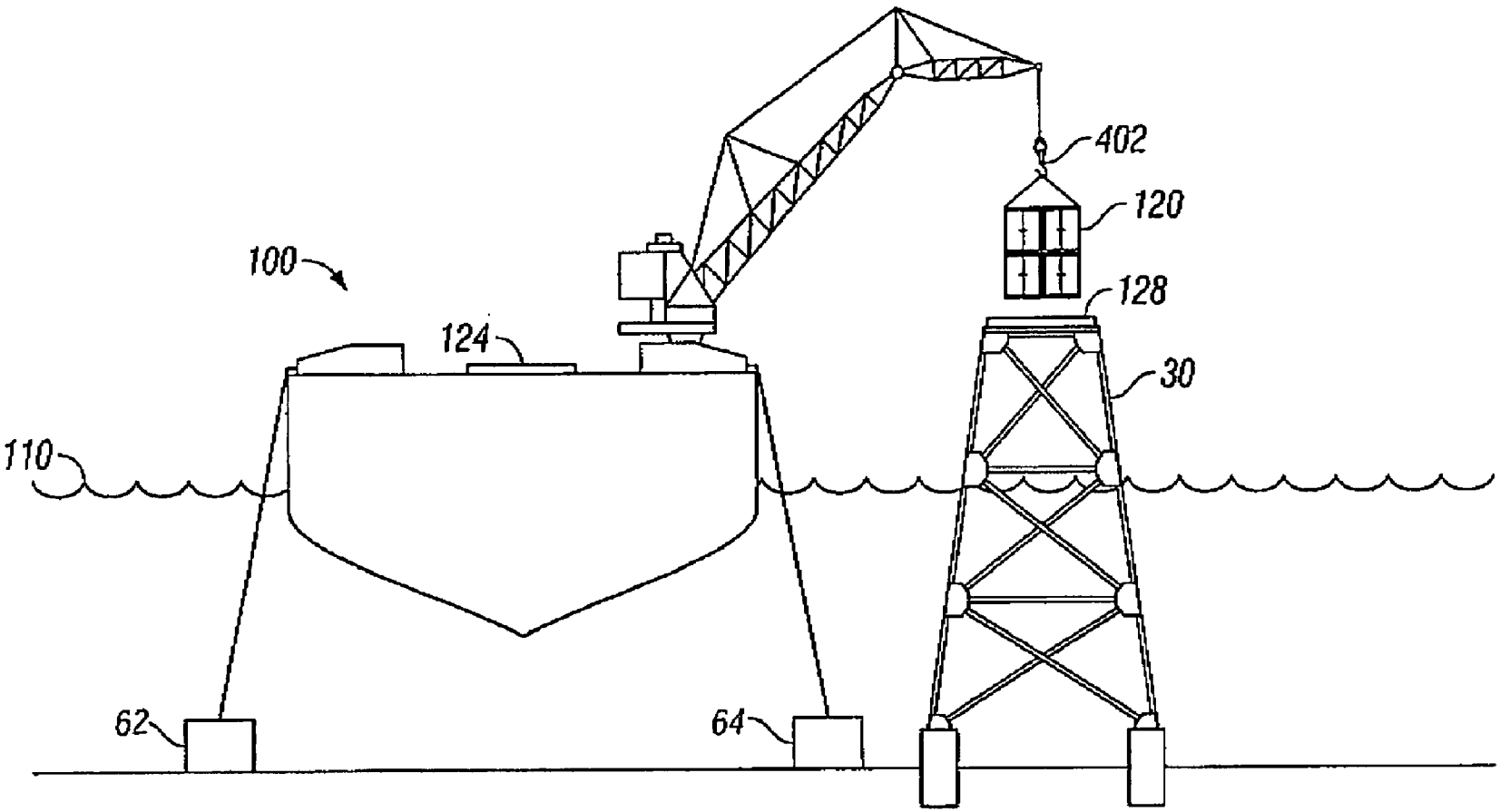
FIG. 5 depicts the heavy lift cranes picking up a load from a first location on a vessel to a second location on another vessel.

While the mooring system maintains the heavy lift vessel at the second position, the method continues by picking up the load (120) from the second location using the first and second cranes simultaneously, shifting the load from a second location (122) to over a third location (128), and placing the load on the third location. This step of the method is shown in FIG. 5.

The first and third locations described in the method can be a second floating vessel (30), an offshore structure, a sea bed, or a land-based location.

Figure 6:
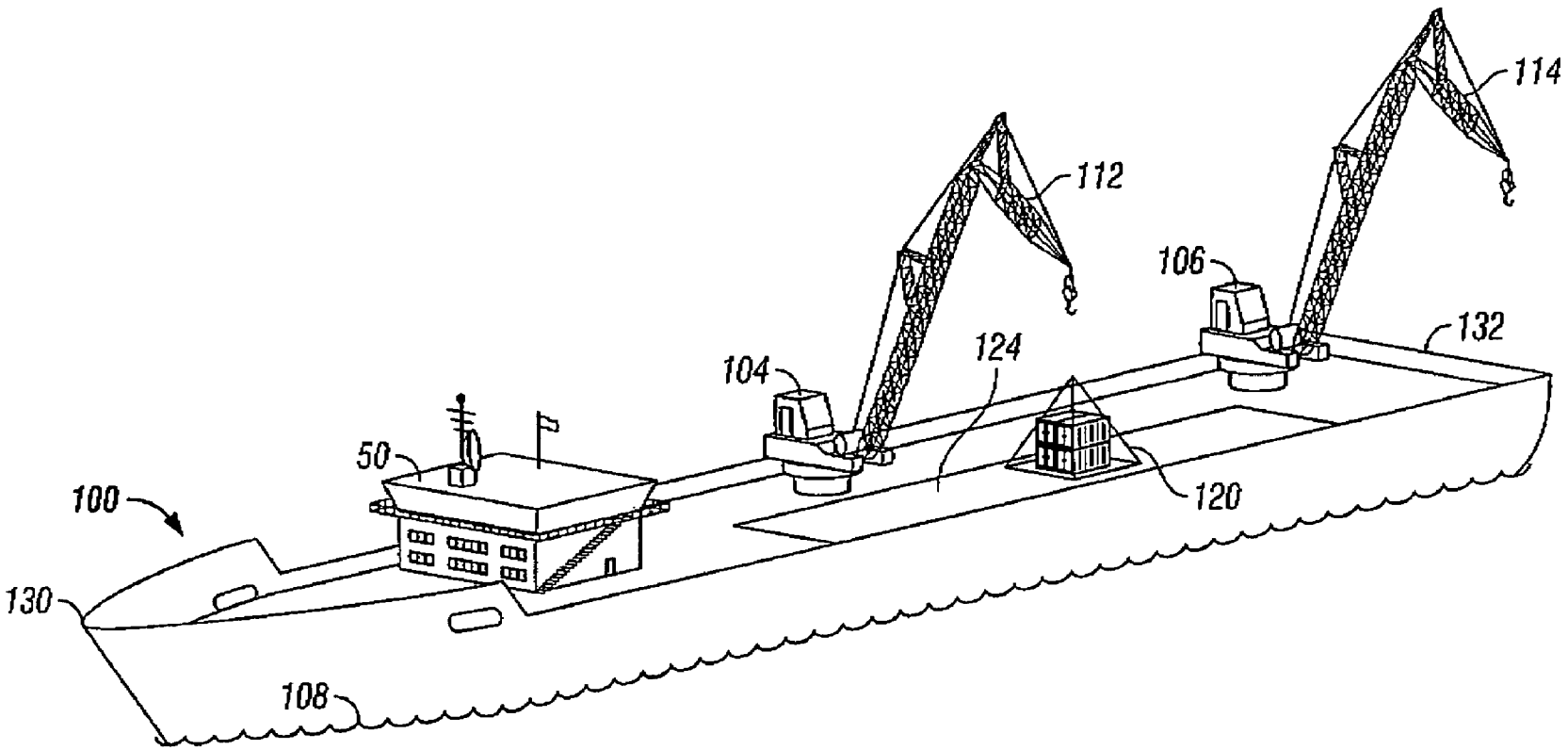
FIG. 6 depicts the heavy lift cranes with fly-jibs.

The present invention contemplates that the heavy lift vessel (100) can be modified by adding a first fly-jib module (112) to the first heavy lift crane and a second fly-jib module (114) to the second heavy lift crane. If a single lift crane is present, a fly-jib can be added to the single crane. The fly-jib modules are adapted to increase reach and height of the each equipped heavy lift crane. The fly-jibs attached to the heavy lift cranes are shown in FIG. 6.

The preferred use of the method is transportation and installation tasks. Examples of items that are transported and installed using this method are topsides and turrets for FPSOs, wind turbine foundations on monopiles or tripod jacket foundations, wind turbine topsides, small offshore platforms and structures, subsea structures like manifolds and valve skids, and vertical tendons for tension leg platforms. The method can also be used for offshore hook-up and maintenance work as well as civil construction work such as transporting and installing bridge foundations and structures.

The present invention offers the advantage of carrying out the transportation of heavy structures over long distance at high speeds (around 14 to 17 knots). The invention is an improvement over current methods that use regular crane vessels to execute the completion of the installation work. Using the same vessel to both transport and install avoids numerous problem areas, which until now are common in offshore construction work. The method avoids the requirement of additional vessels to handle the cargo in an offshore environment. Conventional installation vessels, such as crane barges or crane vessels, require in most cases a separate barge or heavy lift transport vessel to transport the offshore structures. The conventional installation system requires the cargo to be transferred among vessels multiple times. With each lift, the risk of damage to both cargo and workers increase. The method of the invention reduces the number of required lift vessels to one, thereby lowering any risk of loss and possible damage to cargo and lowering the danger to workers.

While this invention has been described with emphasis on the preferred embodiments, it should be understood that within the scope of the appended claims the invention might be practiced other than as specifically described herein.

What is claimed is:

1. A method for lifting and transporting a heavy load comprising the steps of:

a. using a heavy lift vessel comprising a bow and a stern, wherein the heavy lift vessel comprises a first heavy lift crane and a second heavy lift crane connected to the heavy lift vessel adapted to operate simultaneously, and wherein lift vessel is located at a first position;

b. picking up a load from a first location using the first and second heavy lift cranes simultaneously and a first deep water deployment system in connection with the first heavy lift crane and, a second deep water deployment system in connection with the a second heavy lift crane, wherein the first heavy lift crane comprises a first hook, wherein the first deep water deployment system is adapted to increase travel of the first hook of the first heavy lift crane, and wherein the first deep water deployment system comprises:

i. a main hoist winch;

ii. a wire rope disposed in the heavy lift vessel; and iii. a plurality of guide sheaves;

wherein the second lift crane comprise a second hook, wherein the second deep water deployment system is adapted to increase travel of the second hook of the second heavy lift crane, and wherein the second deep water deployment system comprises:

i. a second main hoist winch;

ii. a second wire rope disposed in the heavy lift vessel; and iii. a second plurality of guide sheaves;

c. shifting the load from the first location over to a second location, wherein the second location is on the heavy lift vessel;

d. placing the load on the second location;

e. moving the heavy lift vessel to a second position;

f. using a mooring system to maintain the heavy lift vessel at the second position wherein the mooring system is a conventional anchoring system.

2. The method of claim 1, wherein the main hoist winch is a traction winch, a linear winch, or a normal winch.

3. The method of claim 1, wherein the step of using the second deep water deployment system further comprises using a heave compensator.

4. A method for lifting and transporting a heavy load comprising the steps of:

a. using a heavy lift vessel comprising a bow and a stern, wherein the heavy lift vessel comprises a first heavy lift crane and a second heavy lift crane connected to the heavy lift vessel adapted to operate simultaneously, wherein the heavy lift vessel is located at a first position; and wherein a first fly-jib module is mounted to the first heavy lift crane and a second fly-jib module is mounted to the second heavy lift crane, wherein the first and second fly-jib modules are adapted to increase reach and height of the first and second heavy lift cranes;

b. picking up a load from a first location using the first and second heavy lift cranes simultaneously and a first deep water deployment system in connection with the first heavy lift crane, wherein the first heavy lift crane comprises a first hook, wherein the first deep water deployment system is adapted to increase travel of the first hook of the first heavy lift crane, and wherein the first deep water deployment system comprises:

i. a main hoist winch:

ii. a wire rope disposed in the heavy lift vessel; and iii. a plurality of guide sheaves;

c. shifting the load from the first location over to a second location, wherein the second location is on the heavy lift vessel;

d. placing the load on the second location;

e. moving the heavy lift vessel to a second position;

f. using a mooring system to maintain the heavy lift vessel at the second position, wherein the mooring system is a conventional-anchoring system comprising at least two anchors connected to the bow of the heavy lift vessel and a seabed;

g. picking up the load from the second location using the first and second heavy lift cranes simultaneously;

h. shifting the load from a second location to over a third location; and i. placing the load on the third location.

* * * * *